United States Patent [19]

Johnson et al.

[11] Patent Number: 4,501,563

[45] Date of Patent: Feb. 26, 1985

[54] MARKER BUOY

[76] Inventors: Robert W. Johnson, 25 Muirfield Dr., Arden, N.C. 28704; Richard S. Hobbs, R.D. #5, Box 394, Seneca, S.C. 29678

[21] Appl. No.: 476,191

[22] Filed: Mar. 17, 1983

[51] Int. Cl.[3] ..... B63B 21/52

[52] U.S. Cl. ..... 441/6; 242/96; 441/26; 441/28

[58] Field of Search ..... 441/6, 21, 23, 26, 28; 24/67.9; 242/96

[56] References Cited

U.S. PATENT DOCUMENTS

| | | | |
|---|---|---|---|
| 2,133,337 | 10/1938 | Zvanut | 242/96 |
| 2,977,608 | 4/1961 | Brown, Sr. et al. | 441/6 |
| 4,170,052 | 10/1979 | Okerblom | 24/67.9 |
| 4,285,477 | 8/1981 | Oxendahl | 242/96 |

*Primary Examiner*—Sherman D. Basinger

*Attorney, Agent, or Firm*—David M. Carter

[57] ABSTRACT

There is provided a marker buoy useful to indicate the location of an underwater structure. The buoy is made from a material having a density less than water, including first and second elongated side members and a central portion therebetween. The central portion receives an elongated twine having a weight attached to its far end. Each side member has a stud extending away therefrom at opposing ends of the buoy. The buoy automatically rotates to dispense the twine when the buoy is placed on the surface of water, and is adapted to be manually rotated by manipulation of the studs to retract the twine.

6 Claims, 3 Drawing Figures

MARKER BUOY

BACKGROUND OF THE INVENTION

This invention relates to aquatic marker buoys. More particularly, it relates to marker buoys used by fishermen to dispense a weighted twine to indicate the position of an underwater object.

For many years fishermen have used various configurations of marker buoys to indicate the location of a favorite fishing spot or the location of some underwater object which is not visible from the surface. A good marker buoy should be highly visible from the surface and should be reasonably stable in that it will not wander too far from the object which it is marking, particularly in windy situations.

There are several marker buoys currently on the market which include an elongated length of twine having a lead weight attached to one end, with the other end of the twine wrapped about a central portion or spool. One example of such a marker is the Lindy Dogbone Marker Buoy which is shaped somewhat like a barbell, having a narrow cylindrical portion receiving the twine with a sphere on each end which act as floats. One of the problems with a buoy of this configuration is that in windy conditions the spool will continue to dispense twine even after the leaded weight has bottomed out. Manufacturers have gone to great lengths to stabilize buoys, for example, adding ballast weights. However, this greatly increases the cost of the buoy.

Another problem which has yet to be solved by buoy manufacturers is the cumbersome way in which the twine is retracted onto the spool. Obviously the twine is wet, and sometimes cold, and quite often if the buoy has been in place for several days or weeks algae has formed on the twine. In prior art buoys it is necessary for the fisherman to hold one side of the buoy with one hand and hold the twine with his other hand while wrapping the twine about the central portion or spool of the buoy as he allows the twine to slide through his hands. Obviously this method of retracting twine onto the buoy is very cumbersome, time consuming, and can be very unpleasant.

OBJECTS OF THE INVENTION

It is therefore one object of this invention to provide an improved marker buoy. It is another object to provide a marker buoy in which the twine which is attached thereto can be conveniently and easily retracted onto the buoy. It is still another object to provide a marker buoy with improved stability on the surface of the water.

SUMMARY OF THE INVENTION

In accordance with one form of this invention there is provided a marker buoy made from a material enabling the buoy to float on the surface of a liquid. The buoy has first and second side members and a central portion located between the side members. A first stud extends from the first side member and a second stud extends from the second side member. The first stud is near one end of the buoy on the first side and the second stud is near the opposite end of the buoy on the second side. The central portion receives an elongated twine having a weight attached to its far end. The buoy automatically rotates to dispense the twine and the buoy is placed on the surface of a liquid. The buoy is adapted to be manually rotated by manipulation of the studs to retrieve the twine.

BRIEF DESCRIPTION OF THE DRAWINGS

The subject matter which is regarded as the invention is set forth in the impending claims. The invention itself, however, together with modifications and variations thereof may be better understood in reference to the following description taken in conjunction with the accompanying drawings in which:

DESCRIPTION OF THE PREFERRED EMBODIMENT

Figure 1:
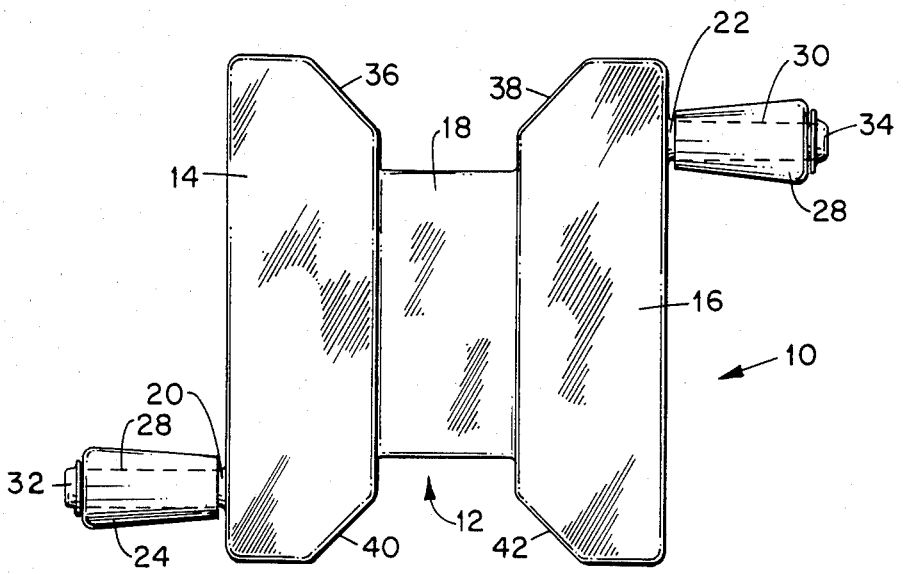
FIG. 1 is a top-plan view of the marker buoy of the subject invention.
Figure 2:
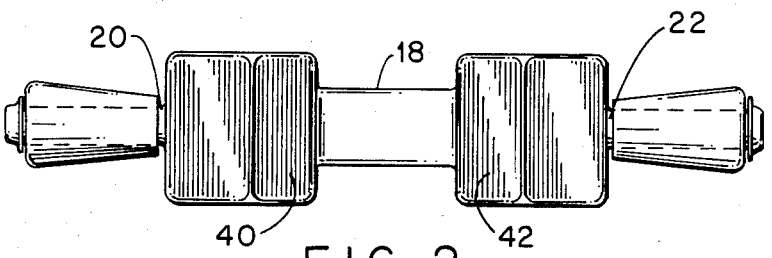
FIG. 2 is an end elevational view of the buoy of FIG. 1.

Referring now more particularly to FIG. 1, there is provided marker buoy 10, which is primarily made from very buoyant styrene material. The buoy is normally painted a bright yellow for good visibility. The buoy includes a body member 12, normally made from a single mold, and includes first and second side members 14 and 16. The side members are elongated pontoons which stabilize the buoy on the surface of the water in windy conditions. A central portion, or spool 18, is connected between the side members. Stud 20, which is integral with the body 12, extends from side member 14, while stud 22 which is also integral with body 12, extends from side member 16. Most of the length of studs 20 and 22 are shown in phantom for exemplification in FIG. 1. Handles 24 and 26, having inner cylindrical surfaces 28 and 30 again shown in phantom, are received over studs 20 and 22 respectively.

End caps 32 and 34 fit over the far ends of studs 20 and 22 respectively to secure the handles onto the studs and thus onto the styrene body 12. As can be seen, the diameter of the inner hollow cylinder of the handles are somewhat larger than the diameters of the studs. Furthermore, there is a space between the handles and the outside surfaces of the side members. Therefore, the studs will freely rotate within the handles.

As can be seen, the central portion 18 is quite a bit shorter than the side members or pontoons 14 and 16. There are four incline surfaces, namely, 36, 38, 40 and 42, which slant inwardly from the far ends of the side members toward the central portion, or spool. Each pair of incline surface on the respective ends of the buoy act as a guide during the retraction of the twine. This will be more readily apparent in reference to FIG. 3, which shows twine 44 fully wrapped or spooled about central portion 18.

A bendable leaded weight 46, is attached to one end 48 of twine 44. The weight is elongated and is bent around both the top side of the spool containing the twine which is shown, and the bottom side which is not shown. The other end of the twine is simply tied around the central portion or spool 18.

Figure 3:
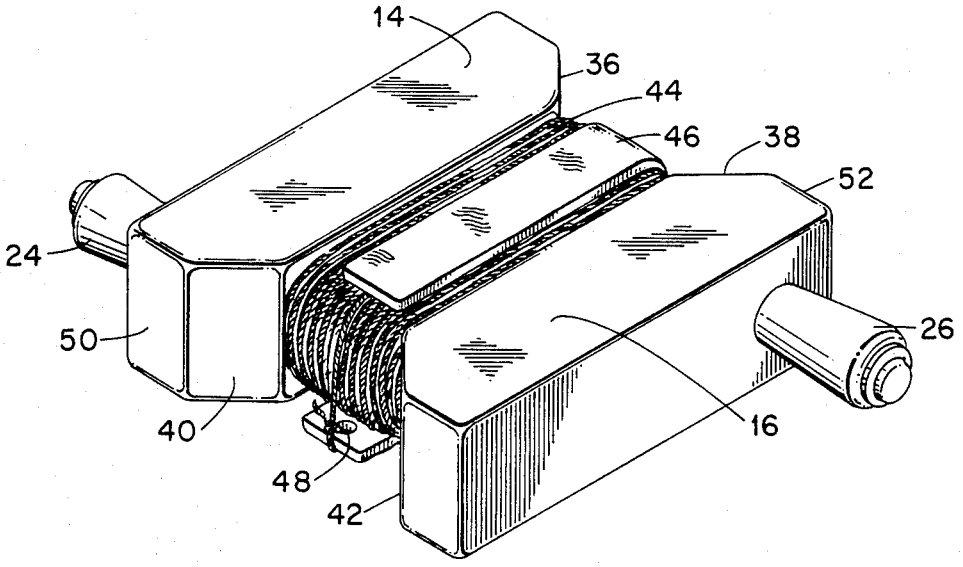
FIG. 3 is a pictoral view of the buoy of FIG. 1, however, including the twine fully retracted.

As can be seen from FIG. 3, handle 24 is near end 50 of side member 14, while handle 26 is near end 52 of side member 16. Thus, it is apparent that the handles are mounted on opposing ends of the respective side members.

In order for a fisherman to operate the buoy, which is in the condition shown in FIG. 3, the underwater obstacle is first located and the leaded weight 46, which is pinching, and thus securing the twine in place so that it will not prematurely be dispensed, is first removed from the central portion 18. In doing so, a very short length of twine will be dispensed. The buoy is then placed on the water with the leaded weight down in the water. The buoy is released and the leaded weight which weighs several ounces, will cause the buoy to rotate as the leaded weight descends into the depths of the water toward the bottom, and the twine will automatically dispense from the buoy until the leaded weight reaches the bottom of the body of water.

Since the side members 14 and 16 are pontoon-shaped, and with the handles 24 and 26 extending therefrom, a great deal of stability is provided, in that additional twine will tend not to unravel even during windy conditions. When the fisherman is ready to retrieve the buoy, and retract the twine, he simply places handle 24 in one hand and handle 26 in the other hand, and manually rotates the buoy, using a circular motion with his hands. The incline surfaces 36, 38, 40 and 42 guide the twine onto central portion or spool 18. This is particularly important in the event that, in his haste, the fisherman fails to properly line up the twine with the central portion or spool, the possibility of the twine fouling will be less.

When the manual winding is completed, the weight 46 is again bent about the twine which is on the spool for storage. Thus it may be seen that a convenient means has been provided to retract twine on a buoy, utilizing handles 24 and 26 mounted near opposing ends of the sides of the buoy. Furthermore, a mechanism for alleviating fouling problems utilizing a guide mechanism has also been provided. Also, in utilizing elongated pontoon-shaped side members with handles projecting therefrom, a highly wind-stable buoy is provided.

From the foregoing description of preferred embodiment it will be apparent that many modifications may be made therefrom. It is intended in the appended claim to cover all such modifications which fall within the true spirit and scope of this invention.

We claim:

1. A marker buoy comprising:

a body made from a material enabling said body to float on the surface of a liquid; said body having first and second side members, and central portion therebetween; the length of said central portion being shorter than the length of either of said side members; said central portion being generally of a solid rectangular shape; each of said side members being in the shape of an elongated pontoon for stabilizing said marker buoy; the length of each of said side members being greater than its width; each of said members having first and second surfaces which taper inwardly toward said central portion; a first stud extending from said first side member and a second stud extending from said second side member; said first stud being near one end of said body and said second stud being near the opposite end of said body; said central portion receiving an elongated twine having a weight attached to its far end; said body automatically rotating to dispense said twine when said body is placed on the surface of a liquid; said body adapted to be manually rotated by manipulation of said studs to retrieve said twine; said first and second tapered surfaces of each of said side members adapted to guide said twine onto said central portion.

2. A marker buoy as set forth in claim 1, further including a handle connected over each of said studs; each of said studs being rotatable within its respective handle.

3. A marker buoy as set forth in claim 1, wherein said body member is made of a material having a density less than water.

4. A marker buoy as set forth in claim 1, wherein said studs are integral with said body.

5. A marker buoy as set forth in claim 1, wherein said weight is an elongated bendable member adapted to wrap around a portion of said twine on said central portion to hold said twine onto said body.

6. A marker buoy as set forth in claim 1, wherein said central portion is inset from the tapering portions of said side members, whereby a substantial portion of said twine which is wound about said central portion does not contact said tapering portions.

* * * * *